US007343750B2

(12) United States Patent
Lifson et al.

(10) Patent No.: US 7,343,750 B2
(45) Date of Patent: Mar. 18, 2008

(54) DIAGNOSING A LOSS OF REFRIGERANT CHARGE IN A REFRIGERANT SYSTEM

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 408 days.

(21) Appl. No.: 10/732,497

(22) Filed: Dec. 10, 2003

(65) Prior Publication Data

US 2005/0126191 A1 Jun. 16, 2005

(51) Int. Cl.
*G01K 13/00* (2006.01)
*F25B 45/00* (2006.01)

(52) U.S. Cl. ..... 62/129; 62/149

(58) Field of Classification Search ..... 62/125, 62/126, 127, 129, 130, 131, 149
See application file for complete search history.

(56) References Cited

U.S. PATENT DOCUMENTS 4,848,096 A * 7/1989 Funahashi et al. ..... 62/126
4,876,859 A 10/1989 Kitamoto
5,009,076 A * 4/1991 Winslow ..... 62/129
5,481,884 A * 1/1996 Scoccia ..... 62/129
5,875,637 A 3/1999 Paetow
6,047,556 A 4/2000 Lifson
6,206,652 B1 3/2001 Caillat
6,330,802 B1 * 12/2001 Cummings et al. ..... 62/129
6,463,747 B1 * 10/2002 Temple ..... 62/129
6,708,508 B2 * 3/2004 Demuth et al. ..... 62/129
2003/0182950 A1 * 10/2003 Mei et al. ..... 62/129

* cited by examiner

*Primary Examiner*—Chen Wen Jiang
(74) *Attorney, Agent, or Firm*—Carlson, Gaskey & Olds

(57) ABSTRACT

A refrigerant system has a controller associated with it that determines an equilibrium pressure when the system is inactive. The controller determines if the equilibrium pressure differs from an expected equilibrium pressure corresponding to a current ambient temperature and the selected refrigerant type. When the difference exceeds a selected threshold, the controller determines that the amount of refrigerant within the circuit is below a desired level. In one example, the controller provides an indication of a low charge amount. The disclosed technique allows early detection of refrigerant charge loss and differentiation between loss-of-charge and other failure modes. Consequently, system performance is enhanced, component damage is prevented, service interruptions and maintenance are reduced, exhaustive troubleshooting is avoided and potential exposure to refrigerant substances is minimized.

18 Claims, 1 Drawing Sheet

DIAGNOSING A LOSS OF REFRIGERANT CHARGE IN A REFRIGERANT SYSTEM

BACKGROUND OF THE INVENTION

This invention generally relates to refrigerant systems. More particularly, this invention relates to determining an amount of refrigerant charge within such systems.

These systems typically are charged at a factory or in the field after installation with an amount of refrigerant to provide adequate system performance for expected operating conditions.

It is possible for the system to lose refrigerant charge through damaged components or loose connections or to be inadequately charged at the factory or in the field. It is necessary to determine refrigerant charge loss to avoid interruptions in service for the customers and prevent a failure of the system components, such as a compressor.

Low refrigerant charge conditions typically do not become apparent until high demand conditions, at high ambient temperatures for example, when full load operation is required to provide the desired amount of cooling. If an inadequate amount of charge is not detected early enough, it leads to the loss of cooling capacity and may cause an interruption in service to the customer. Additionally, system components such as the compressor may malfunction or be damaged if there is an insufficient amount of refrigerant within the system.

It is necessary to diagnose a low refrigerant charge condition as early as possible to ensure adequate system performance and to avoid potential system component damage. Previously suggested techniques such as low suction pressure or evaporator coil freeze up detection can readily be mistaken for a different system malfunction such as evaporator airflow blockage, compressor damage, plugged distributor, indoor fan system failure or another problem. Differentiating between such system malfunction modes and an inadequate amount of refrigerant charge using known techniques requires exhaustive troubleshooting. Moreover, prior approaches do not provide low refrigerant charge amount information early enough to avoid possible component damage.

This invention addresses the need for making an early determination regarding the amount of refrigerant charge within the system.

SUMMARY OF THE INVENTION

In general terms, this invention provides information regarding an amount of refrigerant charge within a refrigerant system based upon equalized system pressure at equilibrium conditions.

One example method of monitoring a refrigerant charge level in the refrigerant system includes determining an equilibrium pressure of the system while the circuit is inactive. If a difference between the determined equilibrium pressure and an expected pressure corresponding to a current ambient temperature exceeds a selected threshold, that indicates that the amount of refrigerant in the system is below a desired level.

In one example, the method includes determining if the equilibrium pressure is below an expected pressure for a determined ambient temperature. In one example, the expected pressure can be tabulated for a plurality of ambient temperatures, respectively.

In one example, the equilibrium pressure is determined before an initial startup of the system. In another example, the equilibrium pressure is determined after the system has been inactive for some time, such as one-half hour, for example.

An example system includes a controller that determines an equilibrium pressure of the system and a current ambient temperature. The controller determines whether the current equilibrium pressure corresponds to an expected equilibrium pressure at the current ambient temperature. When a difference between the current equilibrium pressure and the expected equilibrium pressure exceeds a selected threshold, the controller determines that the amount of refrigerant within the system should be adjusted.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
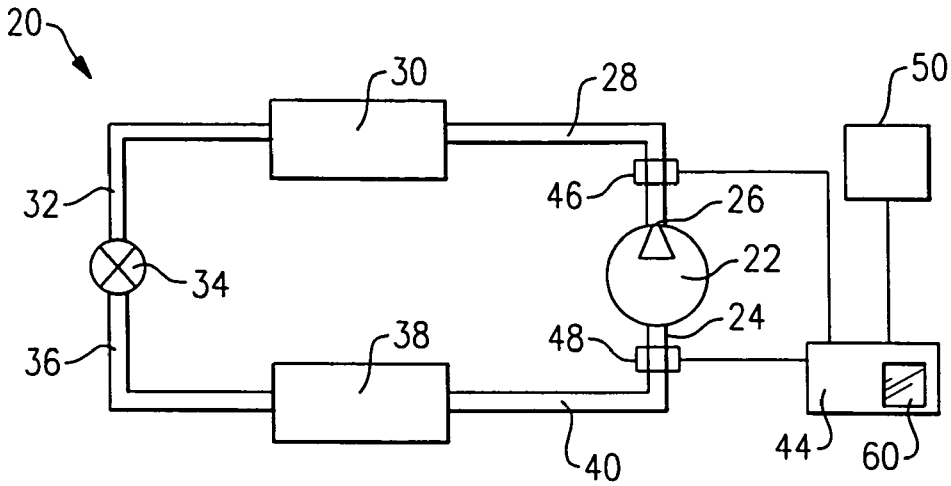
FIG. 1 schematically illustrates a cooling circuit designed according to an embodiment of this invention.

FIG. 1 schematically shows a cooling circuit 20 that is part of an air conditioning system, for example. A compressor 22 draws refrigerant through a suction port 24 and provides a compressed refrigerant under pressure to a compressor discharge port 26. The high temperature, pressurized refrigerant flows through a conduit 28 to a condenser 30 where the refrigerant gas rejects heat and usually condenses into a liquid as known. The liquid refrigerant flows through a conduit 32 to an expansion device 34.

In one example, the expansion device 34 is a valve that operates in a known matter to allow the liquid refrigerant to partially evaporate and flow into a conduit 36 in the form of a cold, low pressure refrigerant. This refrigerant flows through an evaporator 38 where the refrigerant absorbs heat from air that flows across the evaporator coils, which provides cool air to the desired space as known. Refrigerant exiting the evaporator 38 flows through a conduit 40 to the suction port 24 of the compressor 22 where the cycle continues.

The system 20 has a high pressure side between the compressor discharge port 26 and the inlet of the expansion device 34. A low pressure side exists between the outlet of the expansion device 34 and the suction port 24 of the compressor 22.

It should be noted that the above system can also include an economized circuit or other conventional modifications or enhancements as known in the art.

The illustrated system includes a controller 44 that gathers pressure information regarding the circuit 20 to determine whether the amount of refrigerant charge within the system is at an adequate level. In this example, pressure transducers 46 and 48 are associated with the high pressure side and low pressure sides of the circuit, respectively.

The controller 44 uses pressure information regarding the system to determine when the system is at an equilibrium pressure. At equilibrium, as known, the high pressure side and low pressure side of the system are at the same pressure.

In one example, the controller 44 determines the equilibrium pressure information only after the unit has been inactive for an adequate amount of time. In one example, the controller 44 determines the equilibrium pressure information only after the circuit 20 has been inactive for at least one-half hour.

The disclosed techniques are also useful for determining equilibrium pressure information and refrigerant charge amount information prior to an initial startup of the system, when the system is at an equilibrium pressure.

In one example, the controller 44 is programmed to determine whether there is a difference between the pressure on the high pressure side and the low pressure side of the system based on signals from the transducers 46 and 48, for example, to make a determination whether equilibrium has been reached. Assuming equilibrium is achieved, the controller 44 determines what the equilibrium pressure is.

In another example, the controller determines whether a sufficient time, one-half hour for example, has passed since the system was active. Once enough time passes, the controller determines the equilibrium pressure. In this case, only one pressure transducer is needed.

When the system is not operating and the pressures are equalized, there typically is a certain amount of vapor and a certain amount of liquid refrigerant in the system. The equilibrium pressure, corresponding to a specific ambient temperature, depends upon the amount of vapor and liquid within the system. If there is a loss of refrigerant, some of the liquid refrigerant typically evaporates to maintain equilibrium within the system. The liquid will continue evaporating until the entire amount of refrigerant within the system is all in a gaseous state. At that point, as the refrigerant continues to leak, pressure within the system will begin to drop significantly. This pressure drop is an indication that the system is leaking and losing charge.

Figure 2:
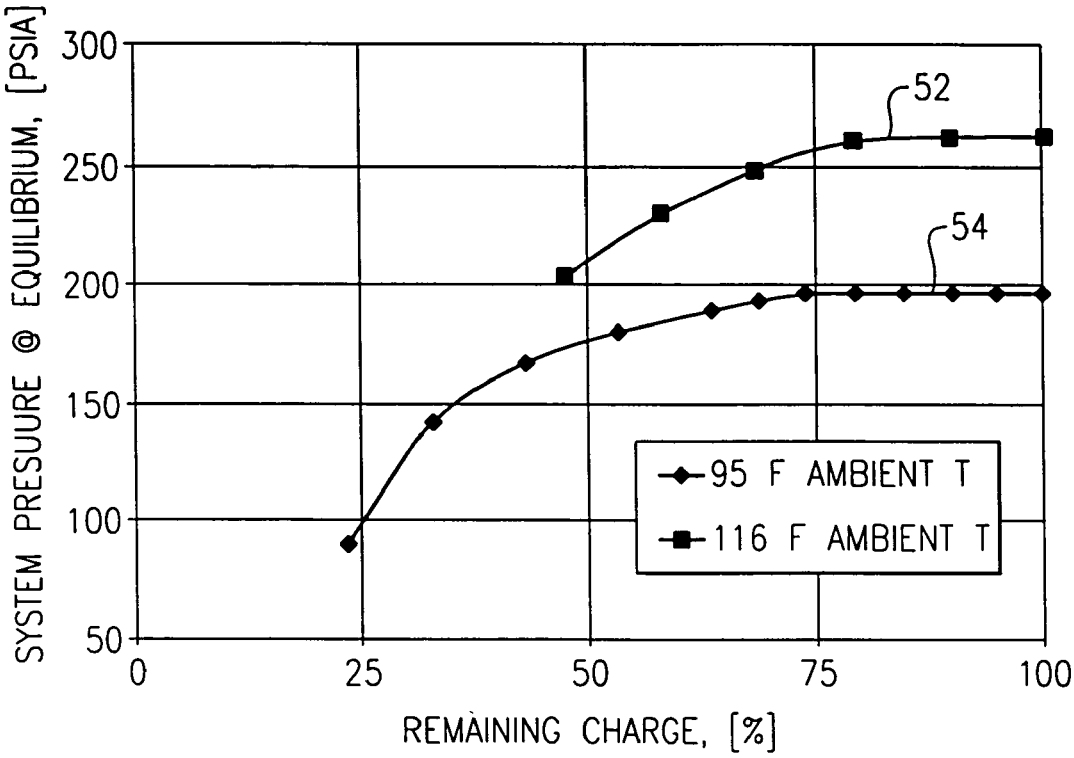
FIG. 2 graphically illustrates example pressure levels corresponding to two different ambient temperatures and various refrigerant charge amounts that are useful with an embodiment of this invention.

For a selected refrigerant and a particular system configuration, there is an expected pressure associated with equilibrium conditions at a specified ambient temperature for an appropriately charged system. There are also known data tables that provide such information for known refrigerants at different temperatures. The controller 44 is provided with information regarding the expected equilibrium pressure corresponding to a variety of ambient temperature conditions. Different ambient temperatures have different corresponding expected pressures corresponding to a saturated refrigerant state. FIG. 2, for example, shows a plot 52 for R22 refrigerant having an expected equilibrium pressure of about 260 PSIA when the ambient temperature is about 116° F. The same system with the same refrigerant has an expected equilibrium pressure of about 196 PSIA when the ambient temperature is 95° F. The controller 44 preferably is provided with information regarding the expected equilibrium pressure for a variety of ambient temperatures.

In the illustration of FIG. 1, a temperature sensor 50, that is located inside or outside of the refrigerant system, provides ambient temperature information to the controller 44.

The controller in one example, makes a determination whether there is any difference between the actual equilibrium pressure and the expected equilibrium pressure based upon current ambient temperature conditions. In the illustrated example, either transducer 46 or 48 provides such pressure information. If there is a difference between actual and expected pressure values, the controller determines that the amount of refrigerant within the system is below the ideal or desired amount. In some examples, a tolerance band is selected so that a difference between the determined equilibrium pressure and the expected equilibrium pressure does not indicate a problem with the refrigerant amount until the tolerance band threshold has been exceeded. Given this description, those skilled in the art will be able to select an appropriate tolerance band or threshold to meet the needs of their particular situation. For example, a different threshold may be useful for different refrigerants or for different temperature ranges.

As can be appreciated from the curve 52 in FIG. 2, when the refrigerant charge has dropped by about 20% at 116° F., there is a significant drop in the system equilibrium pressure and the controller will provide an indication of the refrigerant charge loss. Similarly, the curve 54 shows a significant decrease in system equilibrium pressure when approximately 25% of the charge has been lost at 95° F. A charge loss of this amount typically does not cause any component damage. Accordingly, the controller 44 automatically making a determination regarding a loss of refrigerant at this early stage significantly increases the likelihood of avoiding any component damage if appropriate action is taken responsive to the determination made by the controller.

Additionally, the amount of refrigerant loss can be determined based on the difference in the expected and actual pressure for example. As can be seen from FIG. 2, if the actual pressure is reduced to 100 PSIA compared to an expected 190 PSIA at 95° F. ambient temperature, then the refrigerant charge is down to 25% of full charge.

In the example of FIG. 1, the controller 44 has an associated indicator 60 to provide an indication of a low refrigerant amount determination. In one example, the indicator 60 includes a visible display screen that provides a visual indication regarding the refrigerant charge amount. In another example, the indicator 60 includes an audible alarm that can provide an indication to a technician or customer that the amount of refrigerant within the system should be adjusted.

Accordingly, the disclosed example embodiment of this invention provides the ability to make an early determination regarding any refrigerant charge loss in a refrigerant system in a reliable and economical manner. The early detection capability allows for enhanced system performance, a reduction in interrupted service and maintenance and provides the ability to avoid component malfunctions or damage that might otherwise occur. Additionally, potential exposure to leaking refrigerant will be minimized due to early detection of the refrigerant charge loss. Finally, exhaustive troubleshooting can be avoided, since differentiation between refrigerant charge loss and other failure modes becomes apparent.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of detecting a refrigerant charge loss in a refrigerant system, comprising:

(a) determining an equilibrium pressure while the system is inactive by determining if there is a difference between a pressure on a high side of the system and a pressure on a low side of the system;

(b) determining an ambient temperature; and (c) determining if a difference between an expected pressure corresponding to the determined ambient temperature and the determined equilibrium pressure exceeds a selected threshold.

2. The method of claim 1, wherein step (c) includes determining the expected pressure corresponding to a saturated refrigerant state at the determined ambient temperature.

3. The method of claim 1, including selecting the threshold based, in part, on the ambient temperature.

4. The method of claim 1, including selecting the threshold based, in part, on the refrigerant type.

5. The method of claim 1, including performing steps (a) through (c) prior to startup of the refrigerant system.

6. The method of claim 1, including performing step (a) after the circuit has been inactive for a predetermined period of time.

7. The method of claim 6 where predetermined period of time is at least one-half hour.

8. The method of claim 1, including performing steps (a) through (c) automatically.

9. The method of claim 1, including determining an amount of refrigerant loss based on the amount of difference between the expected and determined pressure.

10. The method of claim 1, including providing a low charge indication when the difference exceeds the selected threshold.

11. A refrigerant system, comprising:

a pressure sensor that provides an indication of a pressure on a high pressure side of the system;

a second pressure sensor that provides an indication of a pressure on a low pressure side of the system;

at least one of the pressure sensors provides an indication of an equilibrium pressure in a circuit of the refrigerant system; and a controller that determines the equilibrium pressure by determining if there is a difference between the pressures on the high pressure side of the system and the low pressure side of the system and determines if a difference between the equilibrium pressure and an expected equilibrium pressure exceeds a selected threshold.

12. The system of claim 11, including a temperature sensor that provides an ambient temperature indication to the controller and the expected equilibrium pressure is based at least in part on the ambient temperature.

13. The system of claim 12, wherein the temperature sensor is at least partially within a component of the system.

14. The system of claim 12, wherein the temperature sensor is external to components of the system.

15. The system of claim 11, wherein the controller determines if the equilibrium pressure is below a saturation pressure.

16. The system of claim 11, wherein the pressure difference threshold is based, in part, on the ambient temperature.

17. The system of claim 11, including an indicator that is operated by the controller to provide an indication of a low refrigerant charge when the difference between the equilibrium pressure and the expected pressure exceeds the selected threshold.

18. The system of claim 11, wherein the controller determines an amount of refrigerant charge in the system relative to an expected charge.

* * * * *